US010421592B2

(12) United States Patent
Genaw, Jr. et al.

(10) Patent No.: US 10,421,592 B2
(45) Date of Patent: Sep. 24, 2019

(54) CLOSURE CAP ASSEMBLY

(71) Applicant: NESTEC S.A., Vevey (CH)

(72) Inventors: Joel Dean Genaw, Jr., Hesperia, MI (US); Matthew Blake Rodgers, Grand Haven, MI (US)

(73) Assignee: SOCIÉTÉ DES PRODUITS NESTLÉ S.A., Vevey (CH)

( * ) Notice: Subject to any disclaimer, the term of this patent is extended or adjusted under 35 U.S.C. 154(b) by 0 days.

(21) Appl. No.: 15/421,840

(22) Filed: Feb. 1, 2017

(65) Prior Publication Data

US 2017/0217652 A1 Aug. 3, 2017

Related U.S. Application Data

(60) Provisional application No. 62/289,533, filed on Feb. 1, 2016.

(51) Int. Cl.
*B65D 51/22* (2006.01)
*B65D 55/02* (2006.01)
(Continued)

(52) U.S. Cl.
CPC ..... *B65D 55/028* (2013.01); *B65D 47/06* (2013.01); *B65D 51/228* (2013.01); *B65D 75/5883* (2013.01); *B65D 2203/12* (2013.01); *B65D 2251/0015* (2013.01); *B65D 2251/0062* (2013.01)

(58) Field of Classification Search
CPC .... B65D 2251/0015; B65D 2251/0071; B65D 2251/0087; B65D 47/106; B65D 55/028; B65D 55/228; B65D 2251/0025
USPC ..... 222/541.2, 541.5, 519; 215/48, 253; 220/258.4
See application file for complete search history.

(56) References Cited

U.S. PATENT DOCUMENTS 3,167,202 A * 1/1965 Tolciss ..... B65D 47/123 215/307
4,176,755 A * 12/1979 Winchell ..... B65D 1/0238 215/48
(Continued)

FOREIGN PATENT DOCUMENTS

DE 102005002471 7/2006
EP 3078603 10/2016
(Continued)

OTHER PUBLICATIONS

International Search Report and Written Opinion from PCT Application No. PCT/IB2017/050544 dated Mar. 10, 2017.

*Primary Examiner* — Charles Cheyney

(57) ABSTRACT

A closure cap assembly for a container having a spout is described. The closure cap assembly includes a spout adapter and a cap. The spout adapter has a tubular body portion and a pull portion. The body portion is configured to be fixed to the spout of the container, and the pull portion is positioned in a flow passage of the body portion. A proximal end of the pull portion is connected to the body portion to form a seal across the flow passage. The distal end extends beyond the distal end of the body portion. The cap has a top end and a bottom end, is connected to the external surface of the body portion, and is connected to the pull portion in a way that the pull portion separates from the body portion as the cap is removed from the body portion.

14 Claims, 5 Drawing Sheets

(51) Int. Cl.
*B65D 47/06* (2006.01)
*B65D 75/58* (2006.01)

(56) References Cited

U.S. PATENT DOCUMENTS

| | | | | | |
|---|---|---|---|---|---|
| 4,405,053 | A * | 9/1983 | Cherot | B65D 1/0238 | 215/331 |
| 4,434,904 | A * | 3/1984 | D'Amico | B65D 55/02 | 215/232 |
| 4,655,355 | A * | 4/1987 | Turoff | B29C 49/20 | 215/48 |
| 4,721,215 | A * | 1/1988 | Bertaud | B65D 1/0238 | 215/253 |
| 5,673,807 | A * | 10/1997 | Valyi | B29C 57/12 | 215/232 |
| 5,678,735 | A * | 10/1997 | Guglielmini | B65D 47/063 | 215/253 |
| 7,427,005 | B1 * | 9/2008 | Lohrman | B65D 51/222 | 222/541.2 |
| 8,235,232 | B2 * | 8/2012 | Isogai | B65D 47/0838 | 215/253 |
| 9,862,528 | B2 * | 1/2018 | Isogai | B65D 47/36 | |
| 10,086,980 | B2 * | 10/2018 | Isogai | B65D 47/106 | |

FOREIGN PATENT DOCUMENTS

| | | |
|---|---|---|
| FR | 2637569 | 4/1990 |
| GB | 2171680 | 9/1986 |
| WO | 2007114692 | 10/2007 |
| WO | 2015083724 | 6/2015 |

* cited by examiner

CLOSURE CAP ASSEMBLY

REFERENCE STATEMENT

The subject application claims benefit under 35 USC § 119(e) of provisional application U.S. Ser. No. 62/289,533, filed Feb. 1, 2016; the entire contents of which are expressly incorporated herein by reference.

STATEMENT REGARDING FEDERALLY SPONSORED RESEARCH AND DEVELOPMENT

Not Applicable.

BACKGROUND

Flexible pouches for containing food and beverage products are frequently marketed for use by infants and small children. The flexible pouches are convenient, inexpensive, and provide ease of use. Typically, the flexible pouches include a spout for discharging the material and a removable closure cap for sealing the pouch. With the closure cap removed, product is able to flow from the spout of the pouch by the user pouring or squeezing the pouch.

The closure caps used for flexible pouches are generally sized to prevent the possibility that they are swallowed by a child. In addition, they are generally provided with a tamper evident feature in the form of a band that becomes separated from a cap body when the cap body is unscrewed from the spout to indicate whether the closure cap has been removed from the spout. For the closure caps currently known, once the closure cap is unscrewed, the tamper evident features breaks into a set of broken sections that remain associated to the cap body so the possibility that such sections are swallowed by a child is reduced. While these sections usually remain associated with the cap body, they can nevertheless be sharp and protrude from the cap body in a way that could harm a child, or they could become detached from the cap body and swallowed. In addition, with the cap body positioned on the spout, the broken sections can be re-positioned to appear as if the seal formed between the closure cap and the spout is not broken.

Another drawback of current closure caps is that that they do not extend into the spout. As such, with the closure cap secured to the spout, the food product contained in the pouch is able to flow into the spout where it is susceptible to oxidation and discoloration.

To this end, a need exists for a closure cap assembly with a tamper evident feature positionable in the spout of a container to provide an audible sound to indicate the breaking of a seal and to create a barrier to product settling in the spout. It is to such a closure cap assembly that the inventive concepts disclosed herein are directed.

DETAILED DESCRIPTION OF EXEMPLARY EMBODIMENTS

Figure 1:
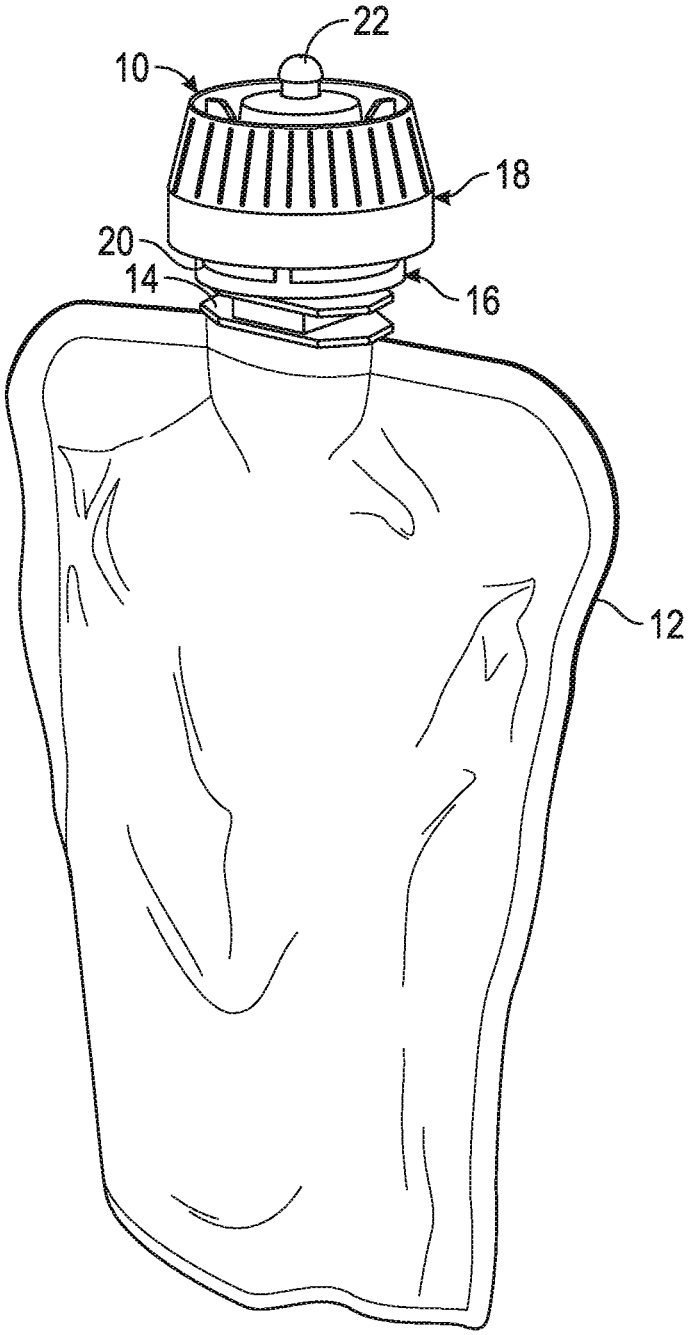
FIG. 1 is a perspective view of a closure cap assembly constructed in accordance with the inventive concepts disclosed herein shown positioned on a container in a sealed condition.

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all integers there between. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, AGB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more of the features of the embodiments described herein.

Referring now the drawings, and more particularly to FIG. 1, a closure cap assembly 10 constructed in accordance with the inventive concepts disclosed herein is illustrated in sealing engagement with a spout 12 of a container 14, such as a flexible pouch. The closure cap 10 is particularly well suited for sealing containers used for flowable foods and juices which are marketed for infants and children. Flexible pouches are well known by those having ordinary skill in the art and, therefore, will not be described in detail herein. In general, the container 14 may be comprised of any non-permeable flexible material. For example, the container 14 may be made of one or more flexible sheets, such as polymer sheets or foil sheets. The container 14 may be used to contain any flowable material. Non-exclusive examples of flowable material include food, beverages, granules, and gases. In one example, the flowable material may be pureed food products or beverages designed for consumption by children.

Referring now to FIGS. 1-5, in an exemplary embodiment, the closure cap assembly 10 includes a spout adapter 16 and a cap 18, The spout adapter 16 is designed to be fixed to the spout 14 of the container 12 after the container 12 has been filled with a selected food product via the spout 14. The cap 18 is initially positioned on the spout adapter 16, but is selectively removable from the spout adapter 16 to permit the food product of the container 12 to be dispensed from the container 12 via the spout 14 and the spout adapter 16 in a manner to be described below. The cap 18 can be repositioned on the spout adapter 16 to close the spout 14 and the spout adapter 16.

Figure 2:
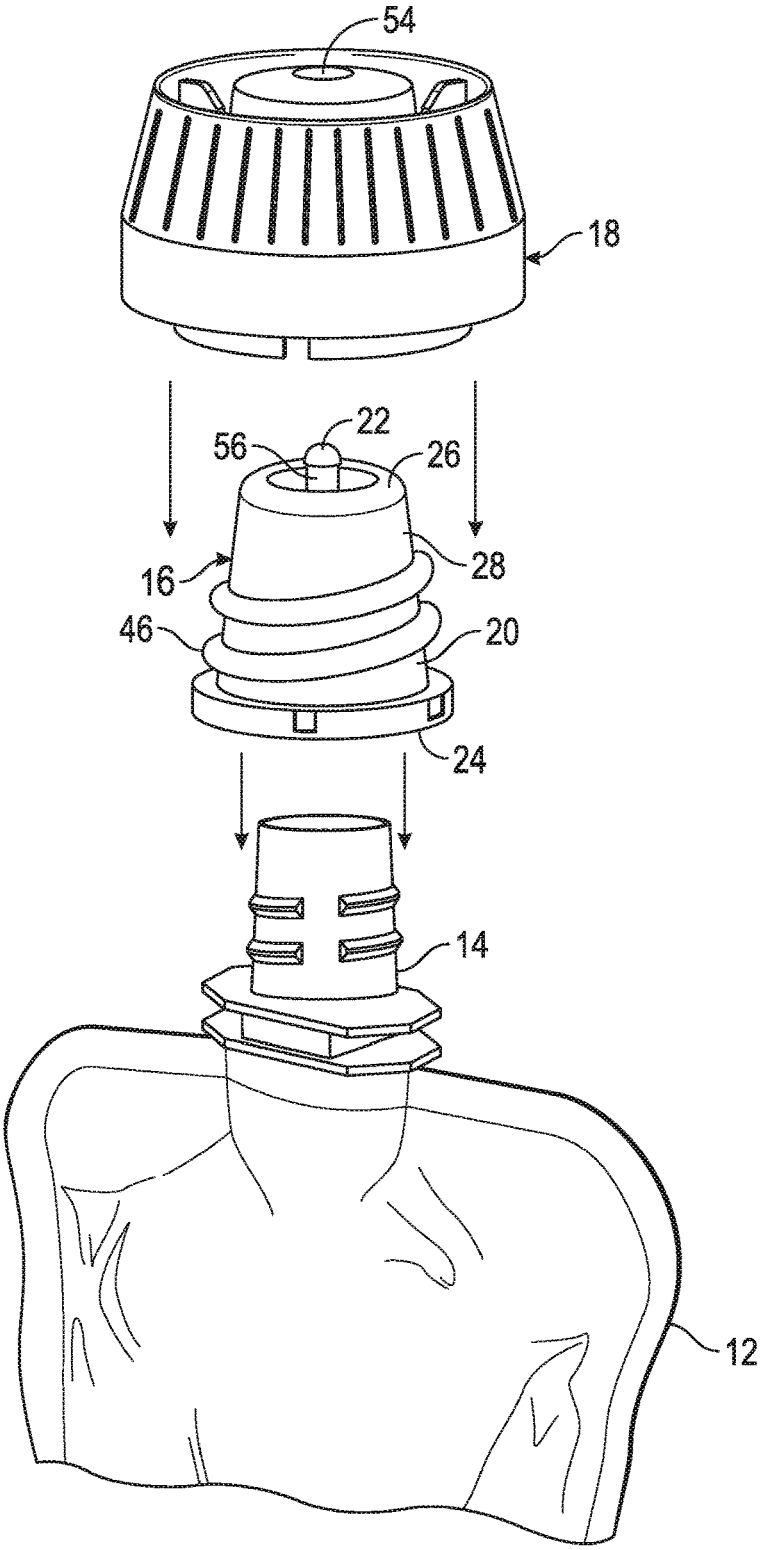
FIG. 2 is an exploded, perspective view of the closure cap assembly and the container.
Figure 3:
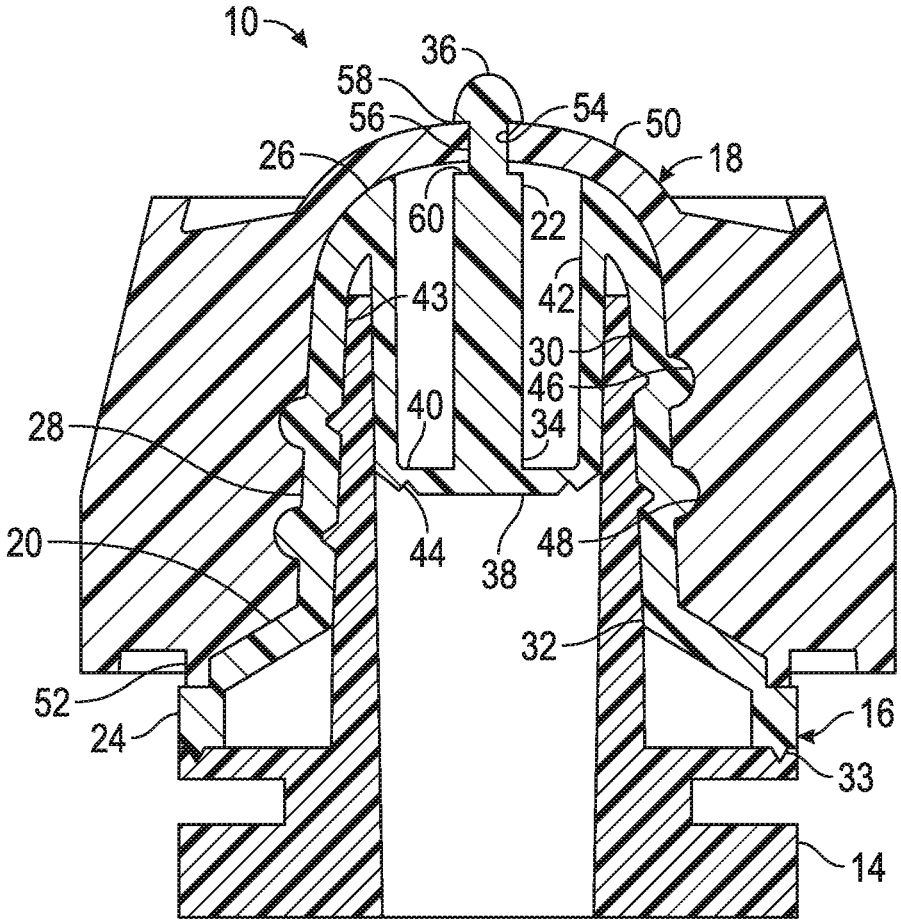
FIG. 3 is a vertical sectional view of the closure cap assembly shown in the sealed condition relative to a spout of the container.
Figure 4:
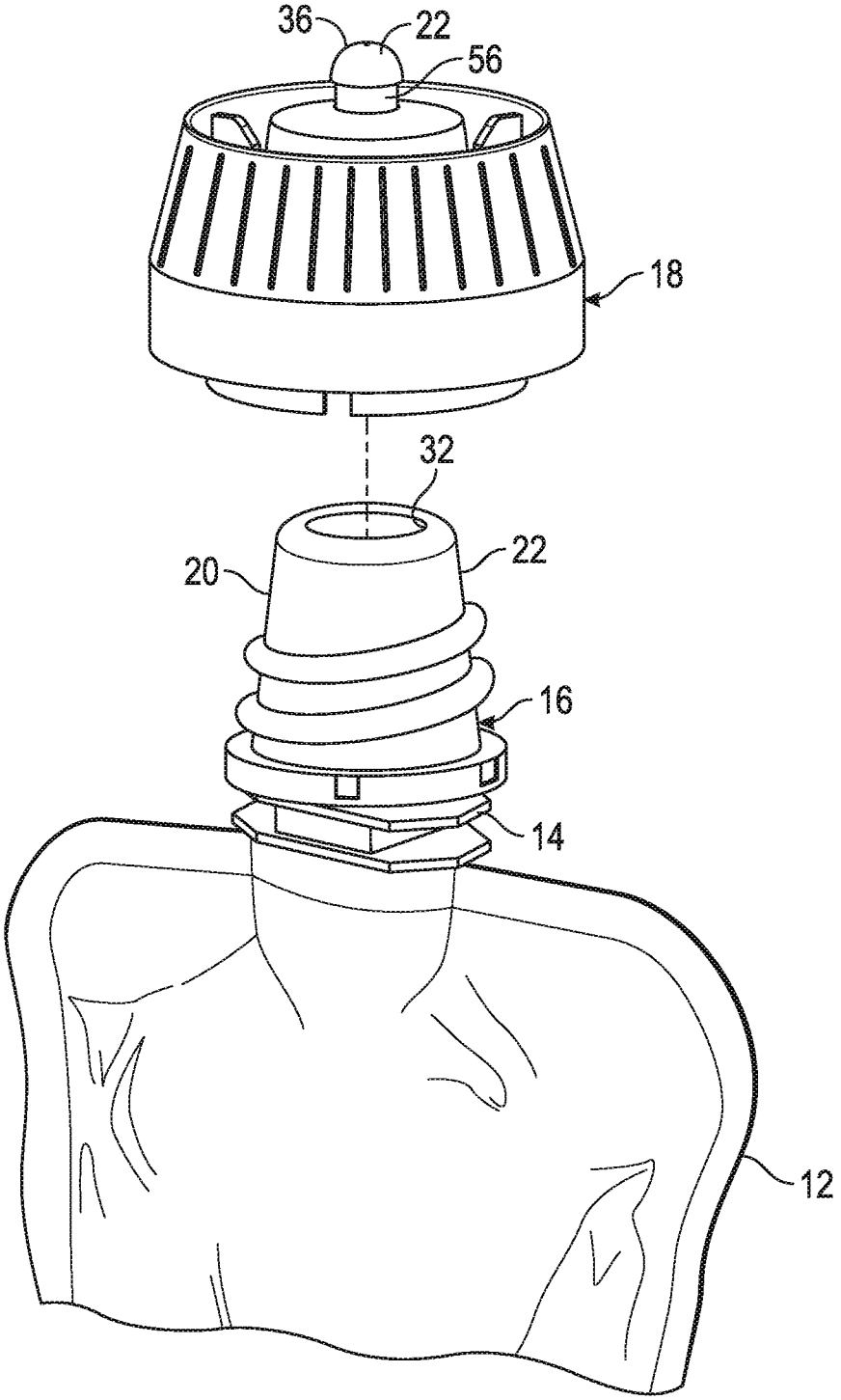
FIG. 4 is a perspective view of the closure cap assembly shown with a cap removed from a spout adapter in an unsealed condition.

Referring now to FIGS. 2 and 3, the spout adapter 16 has a tubular body portion 20 and a pull portion 22. The tubular body portion 20 is characterized as having a proximal end 24, a distal end 26, an external surface 28, and an internal surface 30 defining a flow passage 32 extending through the body portion 20 from the proximal end 26 to the distal end 28. The body portion 20 can be threaded or press-fit or snap-fit to the spout 14 and otherwise fixed to the spout 14 in a variety of ways. For example, the body portion 20 can be fixed to the spout 14 with a suitable adhesive or by welding. In one version, the proximal end 24 may be provided with a plurality of spikes 33 FIGS. 3 and 5) to facilitate fixation between the spout adapter 16 and the spout 14.

As best shown in FIG. 3, the pull portion 22 is illustrated as being generally cylindrically shaped and positioned in the flow passage 32 of the body portion 20 in a coaxial relationship to the body portion 20. The pull portion 22 has a proximal end 34 and a distal end 36. The proximal end 34 of the pull portion 20 is connected to the body portion 20 in a way to form a seal across the flow passage 32 between the proximal end 26 and the distal end 28 of the body portion 20. The pull portion 22 has a length such that the distal end 36 of the pull portion 22 extends beyond the distal end 26 of the body portion 20.

Figure 5:
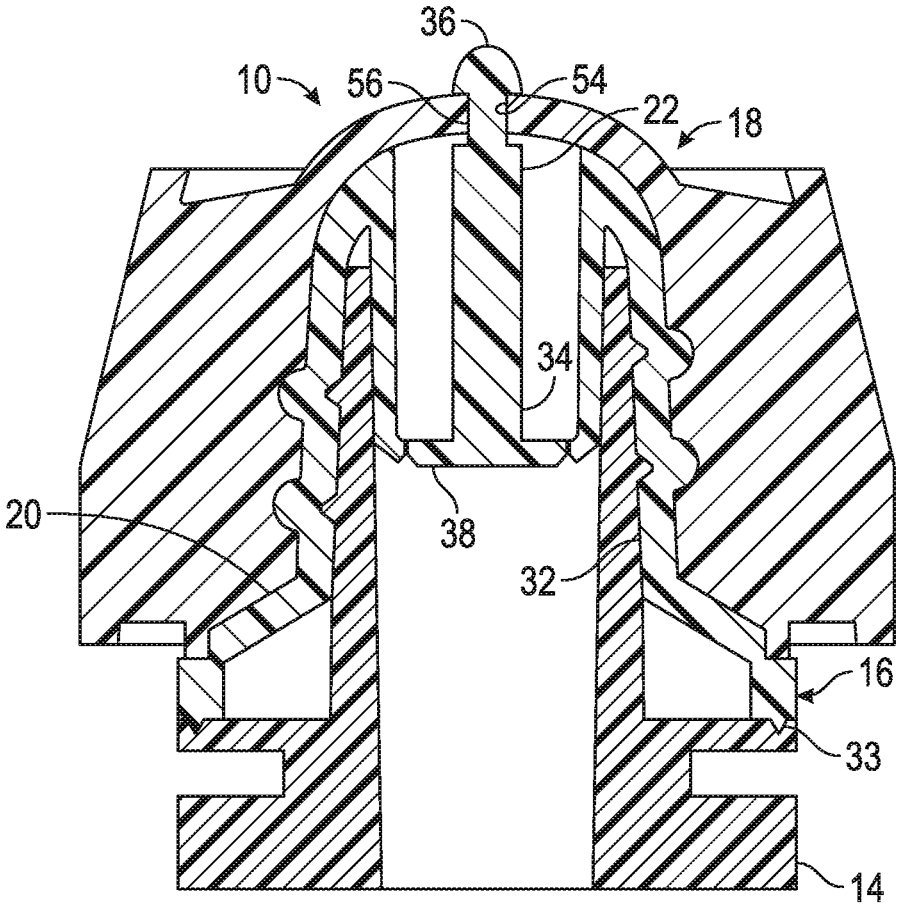
FIG. 5 is a vertical sectional view of the closure cap assembly of FIG. 1 shown in an unsealed condition.

In one embodiment, the body portion 20 and the pull portion 22 are formed as a monolithic unit with the pull portion 22 being connected to the body portion 20 with a membrane 38 extending around the pull portion 22 to form the seal across the flow passage 32 until a user initially opens the container 12. The membrane 38 is provided with a circumferential line of weakness or tear line 40 that frangibly connects the pull portion 22 with the body portion 20. The circumferential line of weakness 40 is spaced outwardly from the proximal end of the pull member 22 such that the proximal end 34 of the pull member 22 is flared after the pull portion 22 separates from the body portion 20 (FIG. 5). In the illustrated embodiment, the membrane 38 includes an annular wall 42 extending downwardly from the distal end 26 of the body portion 20 toward the proximal end 24 of the body portion 20 so as to cooperate with the internal surface 30 of the body portion 30 to define an annular groove 43 for receiving at least a portion of the spout 14 in a way that causes the proximal end 34 of the pull portion 22 to be positioned within the spout 14. The line of weakness 40 is formed by a groove 44 that extends around an underside of the membrane 38 between the annular wall 42 and the proximal end 34 of the pull portion 22. The line of weakness 40 may have other configurations. For example, a groove may be formed in the topside of the membrane 38. The pull portion 22 is connected to membrane 38 in a way that the membrane 38 is torn along the line of weakness 40 by the application of an upward pulling force on the pull portion 22 in a manner to be described below.

The membrane 38, and thus the seal, is shown to extend approximately midway into the flow passage 32. This configuration provides the advantage of positioning the seal within the spout 14 so as to maintain the food product in the lower portion of the flow passage 32 while the seal membrane 38 remains intact, thereby keeping the upper end of the flow passage 32 free of food product where the food product is more susceptible to discoloration from oxidation. It will be appreciated, however, that the membrane 38 may be located at any location in the flow passage 32 between the proximal end 24 and the distal end 26 of the body portion 20. Also, the membrane 38 may be connected to the body portion 20 and the pull portion 22 at other locations along the length of the body portion 20 and the pull portion 22.

The spout adapter 16 can be molded from a variety of suitable polymers and plastics, such as, for example, polyethylene. The body portion 20 may include external threads 46 for threaded engagement with corresponding internal threads 48 of the cap 18. However, it should be appreciated that the cap 18 may engage with the spout adapter 16 in other ways, such as snap-fit.

The cap 18 has a top end 50 and a bottom end 52. As discussed above, the cap 18 is threadingly connected to the external surface 28 of the body portion 20. In addition, the cap 18 is connected to the pull portion 22 in a way that the distal end 36 of the pull portion 22 extends beyond the top end 50 of the cap 18. More particularly, the top end 50 of the cap 18 has an opening 54 through which the pull portion 22 extends. The distal end 36 of the pull portion 22 is tapered to facilitate assembly of the cap 18 with the spout adapter 16 and in particular the cap 18 with the pull portion 22. The pull portion 22 has an annular groove 56 forming a top shoulder 58 and a bottom shoulder 60. The opening 54 of the cap 18 is sized so that the top end 50 of the cap 18 is captured between the top shoulder 58 and the bottom shoulder 60 upon moving the cap 18 past the distal end 36 of the pull portion 22 and so that the cap 18 is rotatable relative to the pull portion 22.

When the closure cap assembly 10 is assembled to the spout 14 by fixing the spout adapter 16 to the spout 14, the distal end 36 of the pull portion 22 extends beyond the top end 50 of the cap 18. Because the pull portion 22 is connected to the body portion 20, the pull portion 22 is non-slidable relative to the cap 18 thereby indicating to a user that the seal across the flow passage 32 is intact.

To open the spout 14 to permit the contents of the container 14 to be dispensed, a user removes the cap 18 from the spout adapter 16 by rotating the cap 18 relative to the spout adapter 16. Rotation of the cap 18 causes the cap 18 to move distally along the body portion 20 of the spout adapter 16. Because the pull portion 22 is connected to the cap 18, the distal movement of the cap 18 causes an upward force to be applied to the pull portion 22. Upon sufficient force being applied to the pull portion 22, the membrane 38 tears along the circumferential line of weakness 40 thereby separating the pull portion 22 from the body portion 20 and opening the flow passage 32. Tearing of the membrane 38 creates an audible sound to the user indicating breaking of the seal. In addition to the audible indicator that the seal is broken, the annular groove 56 of the pull portion 22 has a length such that the pull portion is able to slide relative to the cap 18. Thus, movement of the distal end 36 of the pull portion 22 relative to the cap 18 provides a visual indicator to the user that the seal is broken.

With the cap 18 and the pull portion 22 removed from the body portion 20 of the spout adapter 16 (FIG. 4), the contents of the container 12 are able to be dispensed from the container 12 through the flow passage 32 of the body portion 20.

If desired, the cap 18 can be re-positioned on the body portion 20 of the spout adapter 16 to close the flow passage 32 of the spout adapter 16 by screwing the cap 18 on the body portion 20 (FIG. 5). Because the pull portion 22 remains connected to the cap 18, the flared end of the proximal end 34 of the pull portion 22 serves to push the food product from the upper portion of the flow passage 32 down into the container 12 as the cap 18 travels proximally along the body portion 20 thereby removing the food product from the upper portion of the flow passage 32 where the food product is more susceptible to discoloration from oxidation.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

The invention claimed is:

1. A closure cap assembly for a container having a spout forming a flow passage, the closure cap assembly comprising:

a spout adapter comprising:

a tubular body portion having a proximal end, a distal end, an external surface, and an internal surface defining a flow passage extending through the body portion from the proximal end to the distal end, the inner surface of the body portion comprising a first set of threads, the first set of threads configured to fix the body portion to the spout of the container, the external surface comprising a second set of threads; and a pull portion having a proximal end and a distal end, the pull portion connected to the distal end of the body portion with the proximal end of the pull portion positioned within the flow passage of the body portion and within the flow passage of the spout, the proximal end of the pull portion positioned a distance from the distal end of the body portion so the proximal end of the body portion is positioned within the flow passage of the spout when the body portion is fixed to the spout, the pull portion connected to the body portion to form a seal across the flow passage of the spout between the proximal end of the pull portion and the distal end of the body portion with an entirety of the seal positioned between the proximal end of the pull portion and the distal end of the body portion, the distal end of the pull portion extending beyond the distal end of the body portion; and a cap having a top end and a bottom end, the cap configured to receive the second set of threads to connect the cap to the external surface of the body portion, the cap further connected to the pull portion in a way that the pull portion separates from the body portion as the cap is removed from the body portion, wherein the distal end of the pull portion extends beyond the top end of the cap.

2. The closure cap assembly of claim 1, wherein base portion and the pull portion are formed as a monolithic unit.

3. The closure cap assembly of claim 1, wherein separation of the pull portion from the body portion creates an audible sound indicating breaking of the seal.

4. The closure cap assembly of claim 1, wherein the pull portion is connected to the body portion with a membrane having a circumferential line of weakness.

5. The closure cap assembly of claim 4, wherein the circumferential line of weakness is spaced outwardly from the proximal end of the pull member such that the proximal end of the pull member is flared after the pull portion separates from the body portion.

6. The closure cap assembly of claim 1, wherein the pull portion is slidably connected to the cap after the pull portion separates from the body portion.

7. The closure cap assembly of claim 6, wherein the pull portion has an annular groove defining a top shoulder and a bottom shoulder, and wherein the top end of the cap has an opening through which the pull portion extends and which is sized so that the top end of the cap is captured between the top shoulder and the bottom shoulder.

8. A closure cap assembly in combination with a spout for a container, the spout defining a flow passage, the closure cap comprising:

a spout adapter comprising:

a tubular body portion having a proximal end, a distal end, an external surface, and an internal surface defining a flow passage extending through the body portion from the proximal end to the distal end, the inner surface of the body portion comprising a first set of threads, the first set of threads configured to fix the body portion to the spout of the container, the external surface comprising a second set of threads; and a pull portion having a proximal end and a distal end, the pull portion connected to the distal end of the body portion with the proximal end of the pull portion positioned within the flow passage of the body portion and within the flow passage of the spout, the proximal end of the pull portion positioned a distance from the distal end of the body portion so the proximal end of the body portion is positioned within the flow passage of the spout, the pull portion connected to the body portion to form a seal across the flow passage of the spout between the proximal end of the pull portion and the distal end of the body portion with an entirety of the seal positioned between the proximal end of the pull portion and the distal end of the body portion, the distal end of the pull portion extending beyond the distal end of the body portion; and a cap having a top end and a bottom end, the cap configured to receive the second set of threads to connect the cap to the external surface of the body portion, the cap further connected to the pull portion in a way that the pull portion separates from the body portion as the cap is removed from the body portion, wherein the distal end of the pull portion extends beyond the top end of the cap.

9. The combination of claim 8, wherein separation of the pull portion from the body portion creates an audible sound indicating breaking of the seal.

10. The combination of claim 8, wherein the pull portion is connected to the body portion with a membrane having a circumferential line of weakness.

11. The combination of claim 10, wherein circumferential line of weakness is positioned within the spout.

12. The combination of claim 10, wherein the circumferential line of weakness is spaced outwardly from the proximal end of the pull member such that the proximal end of the pull member is flared after the pull portion separates from the body portion.

13. The combination of claim 8, wherein the pull portion is slidably connected to the cap after the pull portion separates from the body portion.

14. The combination of claim 13, wherein the pull portion has an annular groove defining a top shoulder and a bottom shoulder, and which is sized so that the top end of the cap is captured between the top shoulder and the bottom shoulder.

* * * * *